US005144869A

United States Patent [19]

Chow

[11] Patent Number: 5,144,869

[45] Date of Patent: Sep. 8, 1992

[54] CONTROL DEVICE FOR RATCHET WRENCHES

[76] Inventor: Jessie Chow, No. 18, Houchuang Rd., Pei Twen District, Taichung, Taiwan

[21] Appl. No.: 848,241

[22] Filed: Mar. 9, 1992

[51] Int. Cl.[5] ..... B25B 13/46

[52] U.S. Cl. ..... 81/63; 81/63.2

[58] Field of Search ..... 81/60-63.2, 81/125.1

[56] References Cited

U.S. PATENT DOCUMENTS 915,446 3/1909 Kearnes ..... 81/63

4,862,775 9/1989 Chow ..... 81/63.2

*Primary Examiner*—D. S. Meislin

*Attorney, Agent, or Firm*—Peterson, Wicks, Nemer & Kamrath

[57] ABSTRACT

A ratchet wrench including two ratchet wheels rotatably disposed in the ends of a housing, a pawl pivotally disposed for engagement with the ratchet wheels, a knob rotatably disposed in the middle portion of the housing and extended outwards of the housing so that the knob can be rotated from outside of the housing, a resilient members engaged between each of the pawls and the knob, such that the direction of torque transmission of the ratchet wheels can be controlled when the knob is rotated.

3 Claims, 2 Drawing Sheets

CONTROL DEVICE FOR RATCHET WRENCHES

BACKGROUND OF THE INVENTION 1. Field of the Invention

The present invention relates to a control device, and more particularly to a control device for ratchet wrenches.

2. Description of the Prior Art

The closest prior art of which applicant is aware is his prior U.S. Pat. No. 4,862,775 to Chow, filed Oct. 19, 1988, entitled "CONTROL DEVICE FOR RATCHET WRENCHES". The control device is only suitable for control the ratchet wheel disposed in one end of the ratchet wrench.

The present invention has arisen to mitigate and/or obviate the afore-described disadvantages of the conventional ratchet wrenches.

SUMMARY OF THE INVENTION

The primary objective of the present invention is to provide a control device which can be provided to control the ratchet wheels disposed in both ends of the ratchet wrench.

In accordance with one aspect of the invention, there is provided a ratchet wrench comprising a housing including a hollow interior and including two end portions and including two sides each having a slot formed in a middle portion thereof, a ratchet wheel rotatably disposed in each of the end portions of the housing, a pawl pivotally disposed in the hollow interior of the housing and disposed beside each of the ratchet wheels and including a first tooth and a second tooth for engagement with the ratchet wheels respectively, a knob rotatably disposed in a middle portion of the housing and extended outwards from the slots of the housing such that the knob is reachable and can be rotated from outside of the housing, a depression formed in the knob and a pair of notches oppositely formed in the knob, a disc engaged in the depression of the knob and arranged such that the disc rotates in concert with the knob, the disc including a pair of grooves oppositely formed therein and aligned with the notches of the knob, a pair of resilient members each including a first end engaged with a respective pawl and a second end engaged with the notches of the knob and the grooves of the disc such that either of the first tooth or the second tooth of the pawls is caused to engage with the ratchet wheels when the knob is rotated, whereby, the directions of the torque transmission of both of the ratchet wheels disposed in both ends of the housing can be operated by the pawls and the resilient members when the knob and the disc are rotated.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
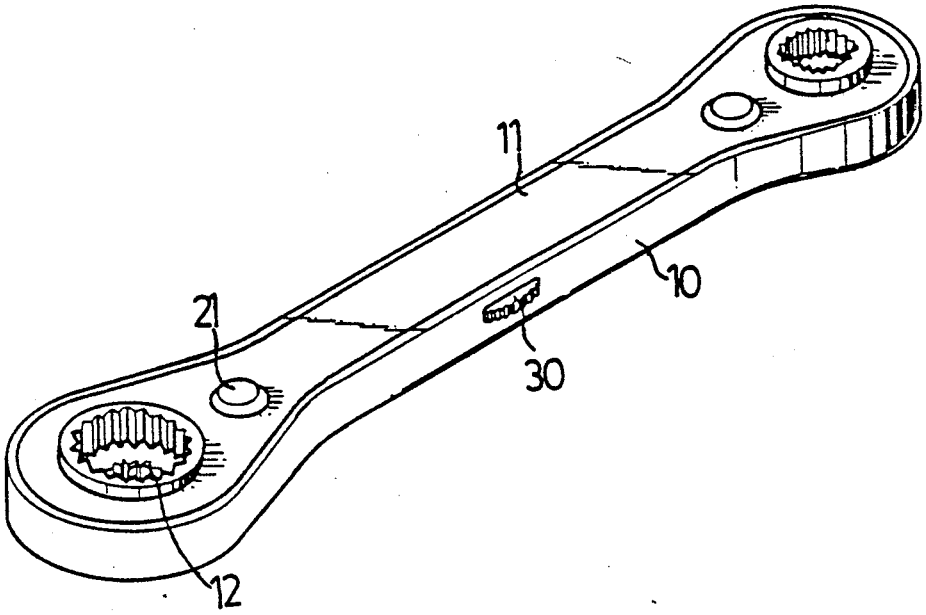
FIG. 1 is a perspective view of a ratchet wrench in accordance with the present invention.

Referring to the drawings, a control device in accordance with the present invention is disposed in a ratchet wrench for controlling the direction of torque transmission of the ratchet wheels disposed in both ends of the ratchet wrench. The ratchet wrench comprises generally a housing 10 having an open upper portion enclosed by a cap 11. A ratchet wheel 12 is rotatably disposed in each end of the housing 10. The control device is disposed in the hollow interior 14 of the housing 10 and disposed between the ratchet wheels 12 in order to control the direction of the torque transmission of the ratchet wheels 12. The housing 10 includes two sides each having a slot 16 formed in the middle portion thereof. A cavity 18 is formed in the middle portion of the housing 10.

The control device includes a pawl 20 pivotally disposed in the housing 10 by a pin 21 and disposed beside each of the ratchet wheels 12. The pawl 20 includes a first tooth 22 and a second tooth 23 for engagement with the ratchet wheels 12 and a pair of legs 24 formed integral thereon such that a gap 25 is formed between the legs 24. A resilient member 26 includes one end engaged in the gap 25 of each of the pawls 20.

Figure 2:
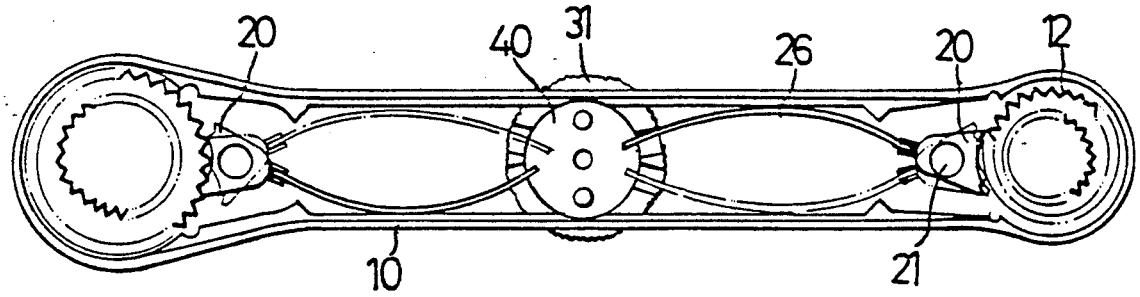
FIG. 2 is a top plane view of the ratchet wrench, in which for clearly illustration purposes, the upper surface of the ratchet wrench is removed.
Figure 3:
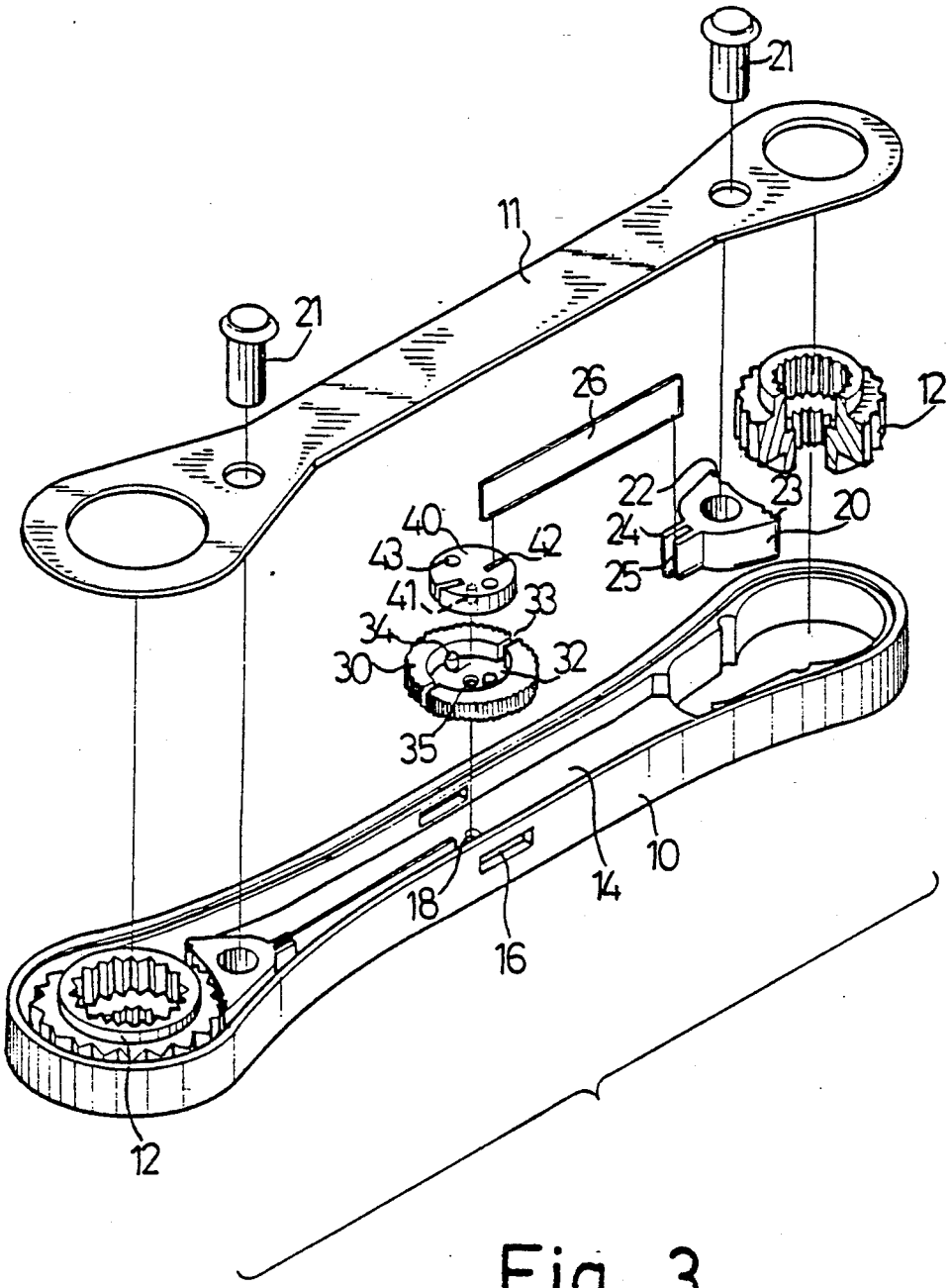
FIG. 3 is an exploded view of the ratchet wrench.

A knob 30 which is circular shaped is rotatably disposed in the housing 10 and has a portion 31 extended outwards of each of the slots 16 of the housing 10, best shown in FIG. 2, such that the knob 30 is reachable from outside of the housing 10 and such that the knob 30 can be rotated by the user. The knob 30 includes a circular depression 32 formed therein and a pair of notches 33 oppositely formed therein for engagement with the resilient members 26. A pair of stubs 34 are formed integral in the depression 32 of the knob 30, and a hole 35 is formed in the center of the knob 30 and aligned with the cavity 18 of the housing 10.

A disc 40 includes a shaft 41 formed integral thereon and extended downward therefrom for engagement with the hole 35 of the knob 30 and the cavity 18 of the housing 10 such that the disc 40 can be pivotally engaged in the hollow interior of the housing 10. The disc 40 includes a pair of grooves 42 oppositely formed therein for engagement with the second ends of the resilient members 26, and a pair of openings 43 formed therein for engagement with the stubs 34 of the knob 30 such that the disc 40 rotates in concert with the knob 30.

In operation, as shown in FIG. 2, when the knob 30 and the disc 40 are rotated, the first tooth 22 and the second tooth 23 of the pawls 20 are caused to engage with the ratchet wheels 12 respectively by the resilient members 26 such that the directions of torque transmission of the ratchet wheels 12 can be controlled.

Accordingly, the control device of the ratchet wrench in accordance with the present invention can be provided to control the ratchet wheels disposed in the end portions of the ratchet wrench.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet wrench comprising a housing including a hollow interior and including two end portions and including two sides each having a slot formed in a middle portion thereof, a ratchet wheel rotatably disposed in each of said end portions of said housing, a pawl pivotally disposed in said hollow interior of said housing and disposed beside each of said ratchet wheels and including a first tooth and a second tooth for engagement with said ratchet wheels respectively, a knob rotatably disposed in a middle portion of said housing and extended outwards from said slots of said housing such that said knob is reachable and can be rotated from outside of said housing, a depression formed in said knob and a pair of notches oppositely formed in said knob, a disc engaged in said depression of said knob and arranged such that said disc rotates in concert with said knob, said disc including a pair of grooves oppositely formed therein and aligned with said notches of said knob, a pair of resilient members each including a first end engaged with a respective pawl and a second end engaged with said notches of said knob and said grooves of said disc such that either of said first tooth or said second tooth of said pawls is caused to engage with said ratchet wheels when said knob is rotated, whereby, both of said ratchet wheels disposed in both ends of said housing can be operated.

2. A ratchet wrench comprising a housing including a hollow interior and including two end portions and including two sides each having a slot formed in a middle portion thereof, a ratchet wheel rotatably disposed in each of said end portions of said housing, a pawl pivotally disposed in said hollow interior of said housing and disposed beside each of said ratchet wheels and including a first tooth and a second tooth for engagement with said ratchet wheels respectively, a knob rotatably disposed in a middle portion of said housing and extended outwards from said slots of said housing such that said knob is reachable and can be rotated from outside of said housing, a depression formed in said knob and a pair of notches oppositely formed in said knob, a pair of stubs formed in said depression of said knob, a disc engaged in said depression of said knob and including a pair of openings formed therein for engagement with said stubs of said knob such that said disc rotates in concert with said knob, said disc including a pair of grooves oppositely formed therein and aligned with said notches of said knob, a pair of resilient members each including a first end engaged with a respective pawl and a second end engaged with said notches of said knob and said grooves of said disc such that either of said first tooth or said second tooth of said pawls is caused to engage with said ratchet wheels when said knob is rotated, whereby, both of said ratchet wheels disposed in both ends of said housing can be operated.

3. A ratchet wrench comprising a housing including a hollow interior having a cavity formed in a middle portion thereof and including two end portions and including two sides each having a slot formed in a middle portion thereof, a ratchet wheel rotatably disposed in each of said end portions of said housing, a pawl pivotally disposed in said hollow interior of said housing and disposed beside each of said ratchet wheels and including a first tooth and a second tooth for engagement with said ratchet wheels respectively, each of said pawls including a pair of legs formed thereon oppositely to said first tooth and said second tooth and arranged such that a gap is formed between said legs, a knob rotatably disposed in a middle portion of said housing and extended outwards from said slots of said housing such that said knob is reachable and can be rotated from outside of said housing, a depression formed in said knob and a pair of notches oppositely formed in said knob, a hole formed in the center of said knob and aligned with said cavity of said housing, a pair of stubs formed in said depression of said knob, a disc engaged in said depression of said knob and including a pair of openings formed therein for engagement with said stubs of said knob such that said disc rotates in concert with said knob, said disc including a shaft extended downward therefrom for engagement with said hole of said knob and said cavity of said housing such that said knob and said disc are rotatable about said shaft, said disc including a pair of grooves oppositely formed therein and aligned with said notches of said knob, a pair of resilient members each including a first end engaged with said gap of a respective pawl and a second end engaged with said notches of said knob and said grooves of said disc such that either of said first tooth or said second tooth of said pawls is caused to engage with said ratchet wheels when said knob is rotated, whereby, both of said ratchet wheels disposed in both ends of said housing can be operated.

* * * * *